US008022830B1

(12) United States Patent
Yang

(10) Patent No.: US 8,022,830 B1
(45) Date of Patent: Sep. 20, 2011

(54) LIFEGUARD ALARM SYSTEM FOR A SWIMMING POOL

(76) Inventor: Ping-Hsun Yang, Sihu Township (TW)

( * ) Notice: Subject to any disclaimer, the term of this patent is extended or adjusted under 35 U.S.C. 154(b) by 0 days.

(21) Appl. No.: 12/813,462

(22) Filed: Jun. 10, 2010

(51) Int. Cl.
*G08B 23/00* (2006.01)

(52) U.S. Cl. ..... 340/573.1; 340/573.6

(58) Field of Classification Search ..... 340/573.1, 340/573, 573.6, 604, 569
See application file for complete search history.

(56) References Cited

U.S. PATENT DOCUMENTS 5,907,281 A * 5/1999 Miller et al. ..... 340/573.6
2010/0030482 A1 * 2/2010 Li ..... 702/19

* cited by examiner

*Primary Examiner* — Shirley Lu

(57) ABSTRACT

A lifeguard alarm system for a swimming pool has a sensing device, at least one electromagnetic wave receiver and a host, the sensing device capable of attaching onto a user; wherein when the sensing device detects the more than two conditions, an microprocessor in the sensing device sends a signal to the at least one electromagnetic wave receiver disposed around the swimming pool and wirelessly connected to the host, and the host sends out an alarm. Furthermore, includes a fail-safe mechanism; therefore, when the first detecting mechanism of the sensing device detects that the user is not in the corresponding predetermined dangerous state, to prevent malfunctioning of the first detecting mechanism from creating problems.

1 Claim, 6 Drawing Sheets

LIFEGUARD ALARM SYSTEM FOR A SWIMMING POOL

BACKGROUND OF THE INVENTION

1. Field of the Invention

The present invention relates to a lifeguard alarm system for swimming pools, and more particularly to a lifeguard alarm system having a sensing device that can obtain the state of the user, and a host that can be notified immediately and send out an alarm when the user is in any dangerous condition for safety purposes.

2. Description of the Related Art

Currently, swimming is a very popular sport, which can strengthen muscles, reduce fat and tone up the body shape. Furthermore, swimming can improve the cardio function of the heart and lungs to prevent many related diseases.

Typical swimming pools have lifeguards standing by to prevent any incident arising from the swimmers; however, sometimes the swimming pool may be too crowded, and the lifeguard thus may be unable to watch over every swimmer. In addition, some swimmers may have unknown health conditions, and accidents almost always occur in a very short period of time. When a dangerous condition arises, the swimmer may not even be able to call for help to draw the lifeguard's attention, which may lead to a deadly result.

Therefore, it is desirable to provide a lifeguard alarm system for a swimming pool to mitigate and/or obviate the aforementioned problems.

SUMMARY OF THE INVENTION

An objective of the present invention is to provide a lifeguard alarm system for a swimming pool.

In order to achieve the above-mentioned objectives, a lifeguard alarm system for a swimming pool comprises a sensing device, at least one electromagnetic wave receiver and a host, the sensing device capable of attaching onto a user; wherein when the sensing device detects the following conditions, a microprocessor in the sensing device sends a signal to the at least one electromagnetic wave receiver disposed around the swimming pool and wirelessly connected to the host, and the host sends out an alarm; wherein:

condition 1: when the user carries the sensing device and enters into the swimming pool, the sensing device activates a first detecting mechanism which detects whether the user is in a predetermined dangerous state set within the detecting mechanism; if the user is in the predetermined dangerous state, a second detecting mechanism is activated to monitor the predetermined dangerous state; if the predetermined dangerous state lasts longer than a predetermined time period, the microprocessor in the sensing device sends a signal to the electromagnetic wave receiver to cause the host to send out a warning alarm;

condition 2: when the second detecting mechanism is activated to monitor the predetermined dangerous state, to improve detecting accuracy, the sensing device further includes a third detecting mechanism which detects whether the user is in the predetermined dangerous state; wherein by collecting data from the first, second and third detecting mechanisms the microprocessor integrates the data to provide a correct signal to the host; and condition 3: when the first detecting mechanism of the sensing device detects the user is not in the predetermined dangerous state, the sensing device activates a fail-safe mechanism to again detect whether the user is not in the predetermined dangerous state; if the fail-safe mechanism detects the user is in the predetermined dangerous state, the microprocessor of the sensing device sends out a signal to the electromagnetic wave receiver placed around swimming pool to cause the host to generate an alarm; if the fail-safe mechanism detects the user is not in the predetermined dangerous state, the sensing device returns to the first detecting mechanism to continuously monitor the user.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
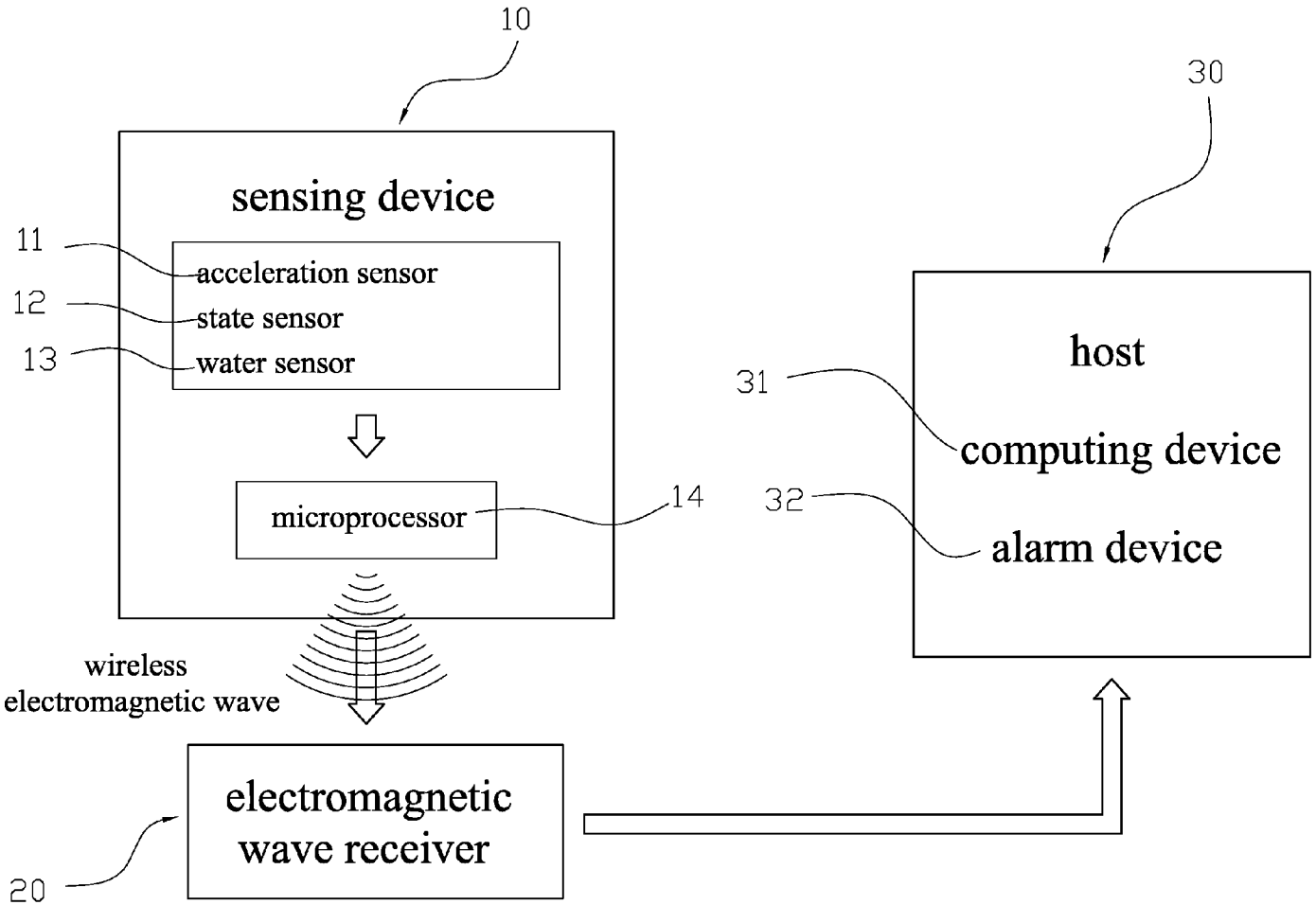
FIG. 1 is a schematic drawing of a lifeguard alarm system according to an embodiment of the present invention.
Figure 2:
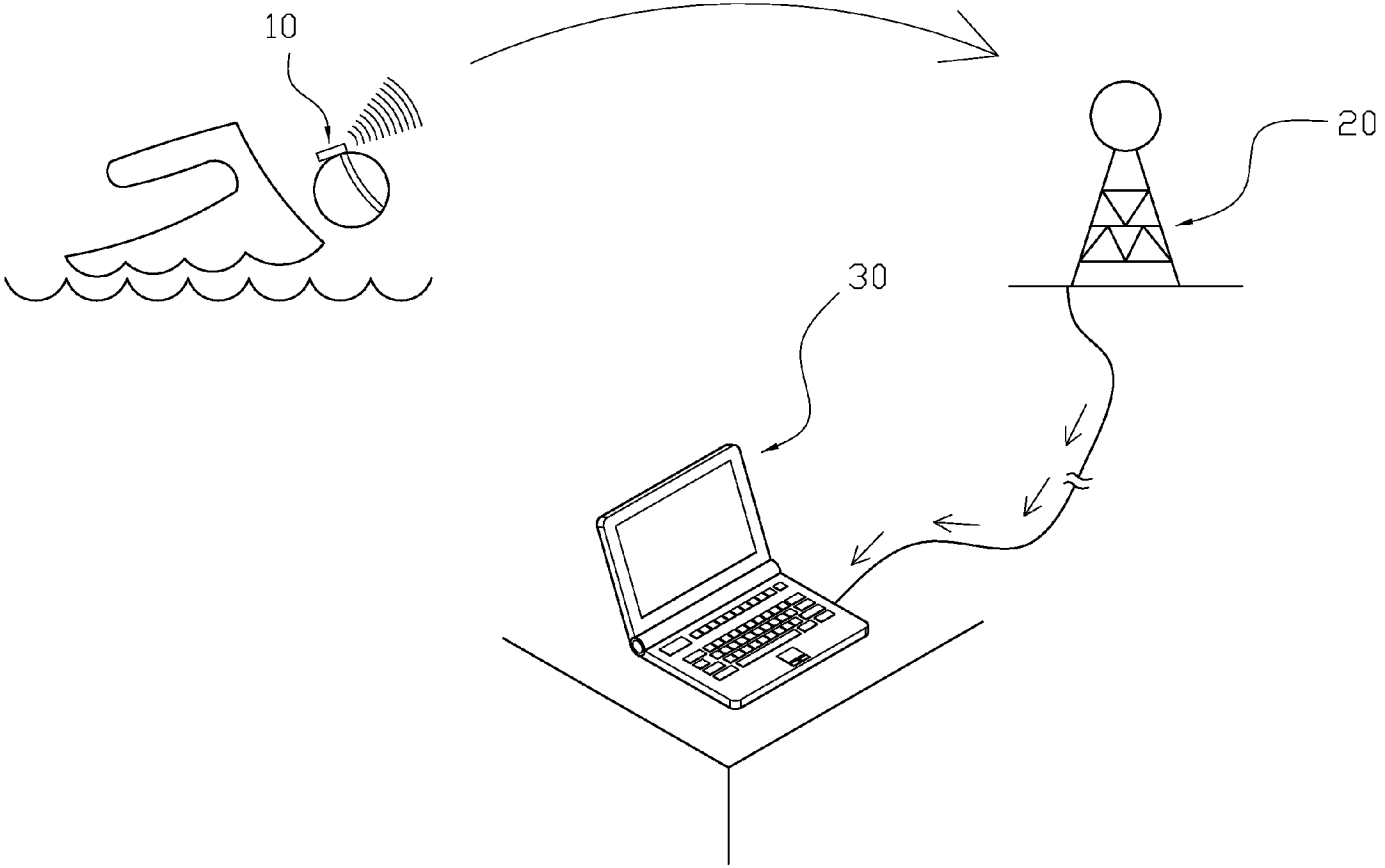
FIG. 2 is a schematic drawing of using the lifeguard alarm system according to an embodiment of the present invention.

Please refer to FIG. 1 and FIG. 2. A lifeguard alarm system for a swimming pool comprises a sensing device 10, at least one electromagnetic wave receiver 20 and a host 30. The sensing device 10 further includes an acceleration sensor 11, a state sensor 12 and a water sensor 13. The acceleration sensor 11 is a G-sensor with a calculation function for measuring speed. The state sensor 12 is a gyroscope for sensing an angular position of the user. The water sensor 13 is a sensor detecting the conductivity or water pressure on the sensing device to determine whether the sensing device 10 is in water and to further calculate a submersion time. The sensing device further includes a microprocessor 14 that directly sends signals to the at least one electromagnetic wave receiver 20 disposed around the swimming pool or integrates signals from the sensors and sends them to the at least one electromagnetic wave receiver 20. The electromagnetic wave receiver 20 is wirelessly connected to the host 30. The host is used for analyzing and processing the signals received by the electromagnetic wave receiver 20. The host 30 further includes a computing device 31 and an alarm device 32 and generates an alarm sound, image or light based on the signals.

Figure 3:
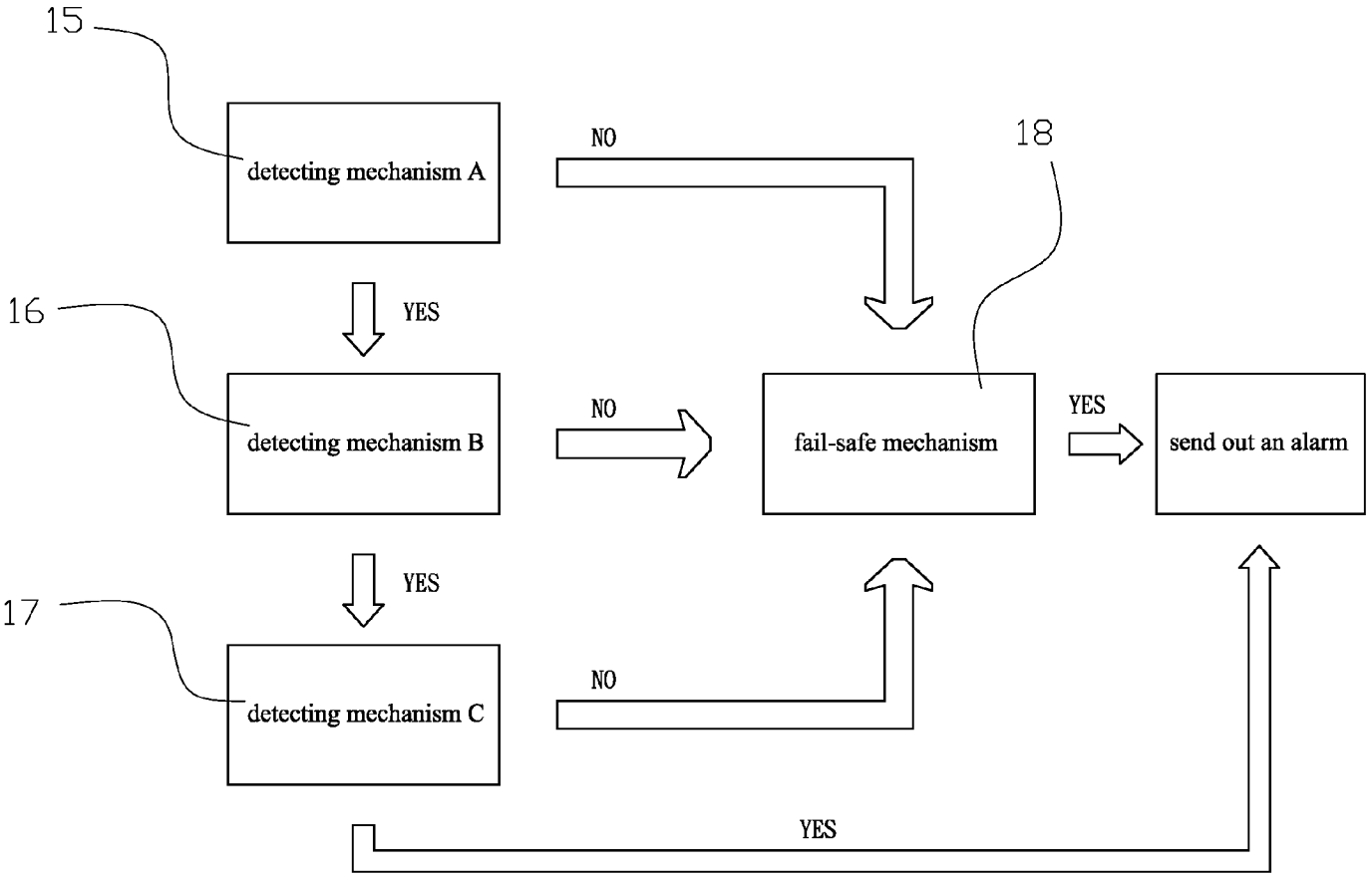
FIG. 3 is a flowchart of a lifeguard alarm system according to an embodiment of the present invention.

Please refer to FIG. 1 together with FIG. 3. The acceleration sensor 11, the state sensor 12 and the water sensor 13 in the sensing device 10 utilize three different detection methods, which include: 1. whether an internal angle between the sensing device and a vertical line during a predetermined time period is greater than a predetermined angle; 2. whether an accumulated horizontal distance during a predetermined time period is less than a predetermined value; or 3. whether an absolute accumulated angular change in attitude differs from a predetermined value. The sensing device 10 comprises a detecting mechanism A 15, a detecting mechanism B 16 and a detecting mechanism C 17 that perform the above-mentioned three methods; the sequence of the performance of the detection methods can be changed. The sensing device 10 further includes a fail-safe mechanism 18; therefore, when the first detecting mechanism of the sensing device detects that the user is not in the corresponding predetermined dangerous state, the sensing device 10 activates the fail-safe mechanism 18 to again confirm whether the user is not in the predetermined dangerous state, to prevent malfunctioning of the first detecting mechanism 15 from creating problems.

Figure 4:
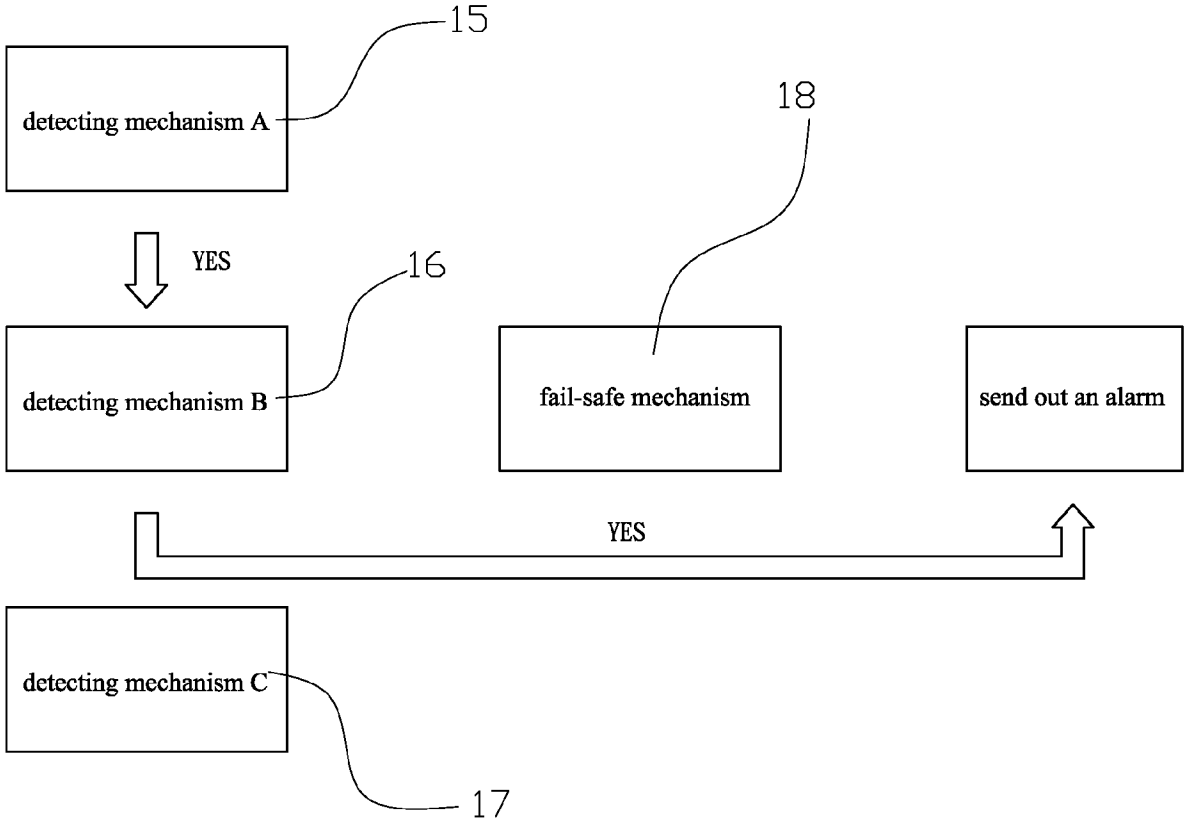
FIG. 4 is a first flowchart of a sensor device according to an embodiment of the present invention.

For actual usage, please refer to FIG. 4.

When the user carries the sensing device 10 and enters the swimming pool, the first detecting mechanism 15 of the sensing device 10 detects whether the user is in a predetermined dangerous state of the first detecting mechanism A; if the user is in the predetermined dangerous state, a second detecting mechanism B 16 is activated to monitor the predetermined dangerous state; if the predetermined dangerous state lasts longer than a predetermined time period, the microprocessor 14 in the sensing device 10 sends signals to the electromagnetic wave receiver 20 to cause the host 30 to send out a warning alarm. Consequently, a lifeguard standing by the swimming pool can rescue the user from distress.

Figure 5:
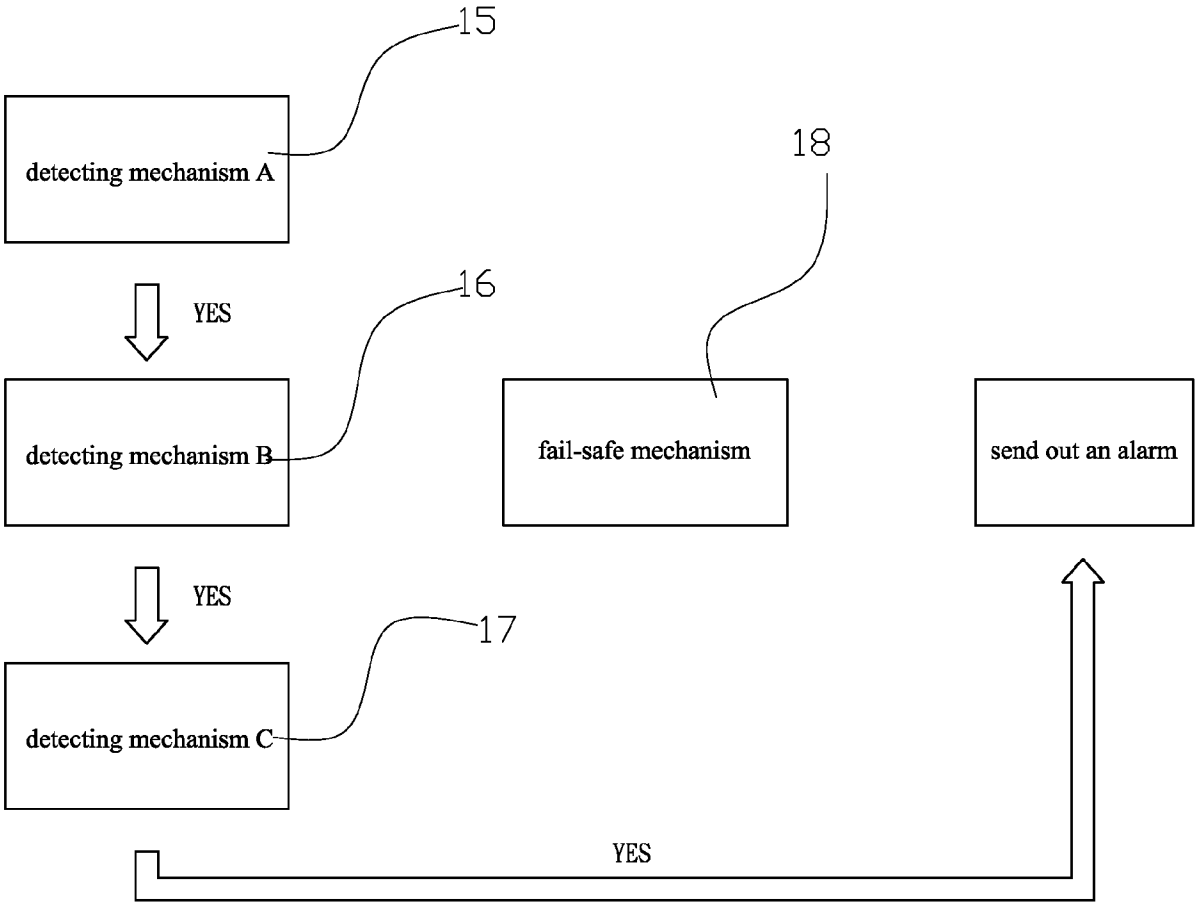
FIG. 5 is a second flowchart of a sensor device according to an embodiment of the present invention.

Please refer to FIG. 5. When the second detecting mechanism B 16 is activated to monitor the predetermined dangerous state, to improve the detection accuracy, the sensing device 10 further includes a third detecting mechanism 17 which detects whether the user is in the predetermined dangerous state; wherein by collecting data from the first, second and third detecting mechanisms 15, 16, 17, the microprocessor 14 integrates the data to provide a correct signal to the host 30.

Figure 6:
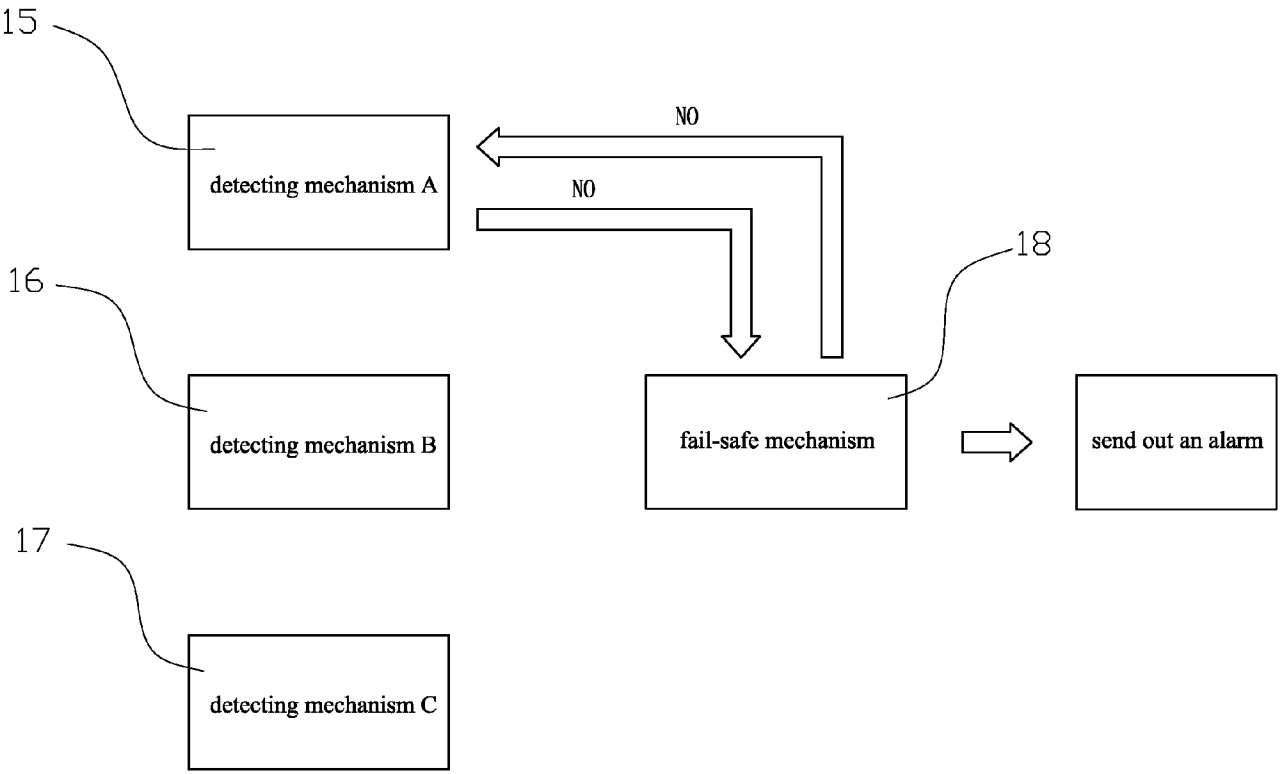
FIG. 6 is a third flowchart of a sensor device according to an embodiment of the present invention.

Further, please refer to FIG. 6. When the first detecting mechanism 15 of the sensing device 10 detects the user is not in the predetermined dangerous state, the sensing device 10 activates a fail-safe mechanism 18 to detect again whether the user is not in the predetermined dangerous state; if the fail-safe mechanism 18 detects the user is in the predetermined dangerous state, the microprocessor 14 of the sensing device 10 sends out signals to the electromagnetic wave receiver 20 placed around the swimming pool to cause the host to generate an alarm; if the fail-safe mechanism 18 detects the user is not in the predetermined dangerous state, the sensing device 10 returns to the first detecting mechanism 15 to continuously monitor the user.

With the structure in the above-mentioned embodiment, the following benefits can be obtained: when the user is in the water, the sensing device 10 can obtain the immersion state of the user, and the host 30 can be notified immediately and send out an alarm when the user is in any of the dangerous states for safety purposes.

Although the present invention has been explained in relation to its preferred embodiment, it is to be understood that many other possible modifications and variations can be made without departing from the spirit and scope of the invention as hereinafter claimed.

What is claimed is:

1. A lifeguard alarm system for a swimming pool comprising:

a sensing device configured for attachment to a user and to wirelessly transmit a warning signal;

at least one electromagnetic wave receiver configured to receive the warning signal; and a host coupled to the at least one electromagnetic wave receiver and configured to generate an alarm in response to the warning signal;

wherein the sensing device comprises:

an acceleration sensor configured to measure speed of the user;

a state sensor configured to measure an angular position of the user;

a water sensor configured to detect whether the sensing device is in water and to calculate a submersion time therein;

first, second and third detecting mechanisms for detecting a dangerous state from mutually different conditions selected from (i) an internal angle between the sensing device and a vertical line during a predetermined time period being greater than a predetermined angle, (ii) an accumulated horizontal distance during a predetermined time period being less than a predetermined value and (iii) an absolute accumulated angular change differing from a predetermined condition;

a fail-safe mechanism configured to detect whether a submersion time of the sensing device exceeds a predetermined time period or the user has abnormal vital signs; and a microprocessor configured to repetitively:

determine whether the dangerous state as detected by the first, second and third detecting mechanisms using mutually different conditions exceeds a predetermined time period;

transmit the warning signal if the dangerous state exceeds the predetermined time period;

utilize the fail-safe mechanism if the dangerous state does not exceed the predetermined time period; and transmit the warning signal if the fail-safe mechanism detects that the submersion time of the sensing device is excessive or the user has abnormal vital signs.

* * * * *